US006638029B2

(12) United States Patent
Kharsa

(10) Patent No.: US 6,638,029 B2
(45) Date of Patent: Oct. 28, 2003

(54) PRESSURE RATIO MODULATION FOR A TWO STAGE OIL FREE COMPRESSOR ASSEMBLY

(75) Inventor: John Kharsa, Westville, IN (US)

(73) Assignee: Hamilton Sunstrand Corporation, Rockford, IL (US)

( * ) Notice: Subject to any disclaimer, the term of this patent is extended or adjusted under 35 U.S.C. 154(b) by 0 days.

(21) Appl. No.: 10/025,229

(22) Filed: Dec. 19, 2001

(65) Prior Publication Data

US 2003/0113214 A1 Jun. 19, 2003

(51) Int. Cl.[7] ..... F04B 25/00
(52) U.S. Cl. ..... 417/250; 417/253
(58) Field of Search ..... 417/250, 253, 417/243

(56) References Cited

U.S. PATENT DOCUMENTS

| | | | | |
|---|---|---|---|---|
| 2,984,404 A | * | 5/1961 | Klein | 230/4 |
| 3,152,753 A | * | 10/1964 | Adams | 230/208 |
| 3,756,753 A | | 9/1973 | Persson et al. | |
| 3,834,413 A | | 9/1974 | Peterson | |
| 4,151,725 A | | 5/1979 | Kountz et al. | |
| 4,815,950 A | * | 3/1989 | Aoki et al. | 417/253 |
| 5,335,507 A | | 8/1994 | Powell | |
| 5,477,697 A | | 12/1995 | Wharton et al. | |
| 5,491,978 A | | 2/1996 | Young et al. | |
| 5,582,022 A | * | 12/1996 | Heinrichs et al. | 62/175 |
| 5,611,216 A | | 3/1997 | Low et al. | |
| 5,626,027 A | | 5/1997 | Dormer et al. | |
| 5,655,379 A | | 8/1997 | Jaster et al. | |
| 5,674,053 A | | 10/1997 | Paul et al. | |
| 5,885,060 A | * | 3/1999 | Cunkelman et al. | 417/243 |
| 5,927,087 A | | 7/1999 | Ishikawa | |
| 5,967,757 A | | 10/1999 | Gunn et al. | |
| 5,974,807 A | | 11/1999 | Gao et al. | |
| 6,027,315 A | | 2/2000 | Hogan | |
| 6,079,952 A | * | 6/2000 | Harte et al. | 417/53 |
| 6,102,665 A | | 8/2000 | Centers et al. | |
| 6,132,177 A | | 10/2000 | Loprete et al. | |
| 6,138,468 A | | 10/2000 | Yokomachi et al. | |
| 6,209,334 B1 | | 4/2001 | Cowans et al. | |
| 6,273,076 B1 | | 8/2001 | Beck et al. | |

OTHER PUBLICATIONS

Alco Valves, 1999, Alco Valves, Alco Needle Valves, 3 pages.*

* cited by examiner

*Primary Examiner*—Charles G. Freay
*Assistant Examiner*—John F. Belena
(74) *Attorney, Agent, or Firm*—Carlson, Gaskey & Olds

(57) ABSTRACT

A two-stage oil free compressor assembly includes a pressure modulation mechanism, which enhances the ambient temperature and altitude capability of the compressor. A selected amount of pressurized fluid is drawn from an output side of a second stage compressor portion and reintroduced into the lower pressure interstage circuit of the assembly, thus raising the interstage pressure. The fluid that flows through the pressure modulation mechanism can be further cooled using the interstage heat exchanger, depending on the needs of a particular situation. A valve in the pressure modulation mechanism is adjusted to control the amount of fluid utilized for pressure modulation. The inventive arrangement permits modulating the pressure ratio of each stage to achieve reasonably balanced discharge temperatures of the first and second stage. The inventive arrangement is particularly useful for situations where the compressor assembly is at a higher altitude, which tends to cause the second stage pressure ratio and discharge temperature to rise undesirably.

26 Claims, 3 Drawing Sheets

PRESSURE RATIO MODULATION FOR A TWO STAGE OIL FREE COMPRESSOR ASSEMBLY

BACKGROUND OF THE INVENTION

This invention generally relates to pressure ratio control in two stage compressor assemblies. More particularly, this invention relates to a modulation technique including a mechanism between an output of a second stage of the compressor assembly and an interstage circuit of the assembly to allow fluid flow as needed for pressure ratio modulation.

Two-stage compressor assemblies are known and used for various purposes. Like other compressor designs, two-stage systems have operating temperature limitations dictated by the capability of coatings, materials and acceptable amounts of distortion. In two-stage assemblies, there is the further possible complication that the discharge temperatures of each stage are not balanced throughout the system operating envelope. This imbalance is mainly attributed to a difference in the pressure ratio, efficiency, inlet air temperature, etc., between the two stages.

When the discharge temperatures of the two-stages of the compressor assembly are not balanced, one stage typically operates at a higher temperature than the other and becomes the limiting factor in the ambient capability of the overall compressor assembly. Accordingly, the capability of the compressor to operate at high ambient temperature levels becomes limited as it is dictated by the stage operating at the higher temperature.

One cause of imbalanced discharge temperatures is when the compressor assembly is located above a certain altitude. For a given system operating pressure, the pressure ratio of the second stage and its discharge temperature increases with an increase in altitude. This phenomenon applies from sea level to the maximum operating altitude of the compressor. It follows that above certain altitudes, the capability of the equipment to operate at higher ambient temperatures becomes limited because of the higher second stage pressure ratio.

There is a benefit in balancing the discharge temperatures of each stage in a two-stage compressor assembly. Without such balancing, unacceptably high temperatures can occur during capacity modulation. One conventional technique used in an attempt to avoid unacceptable high temperatures during capacity control includes loading or unloading the compressor at certain intervals. Typical applications of this technique include either fully opening or nearly closing the compressor assembly inlet valve to maximize or effectively cut off the fluid flow into the assembly. During such cycling (i.e., suddenly loading or unloading the compressor), the compressor assembly components are exposed to load and thermal fluctuations that may adversely affect the system reliability.

There is a benefit in implementing a mechanism which permits modulation of the pressure ratio in two-stage oil free compressor assemblies to achieve more balanced discharge temperatures. The benefits consist of increased ambient temperature and altitude capability as well as providing capacity modulation capability. This invention provides this benefit while avoiding the shortcomings and drawbacks of the prior art.

SUMMARY OF THE INVENTION

In general terms, this invention is a two-stage compressor assembly having pressure ratio modulation useful for balancing discharge temperatures of each stage. This invention applies to various types of oil free compressors, such as rotary, screw, centrifugal, scroll, and piston, for example.

This invention provides enhanced ambient temperature and altitude capability. At the same time, the inventive arrangement provides capacity modulation capability.

An assembly designed according to this invention includes a first stage compressor portion. A second stage compressor portion is fluidly coupled with the first stage compressor portion downstream from the first stage. An interstage circuit is fluidly coupled between the first and second stage portions so that an output from the first stage portion is upstream of the interstage circuit and the second stage compressor portion is downstream from the interstage circuit. A pressure modulation mechanism selectively couples an output from the second stage portion with the interstage circuit. By selectively allowing fluid flow through the pressure modulation mechanism, the pressure ratio of the second stage can be controlled and kept within desired limits.

In one example, a needle valve is part of the pressure modulation mechanism. The needle valve is controlled to allow a desired amount of flow from the output of the second stage portion back to the interstage circuit. In one example, the bypass mechanism couples the output of the second stage compressor portion to the upstream side of the interstage cooler. In another example, the output from the second stage portion is taken downstream from an after cooler, which is downstream from the second stage portion, and introduced downstream of the interstage cooler by the pressure modulation mechanism.

In one example, an electronic controller controls operation of the flow through the pressure modulation mechanism. The controller controls operation of a valve associated with the pressure modulation mechanism so that the valve is gradually opened when a main inlet valve to the compressor assembly is closing. Similarly, the controller gradually closes the pressure modulation mechanism valve when the main inlet valve is opening.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
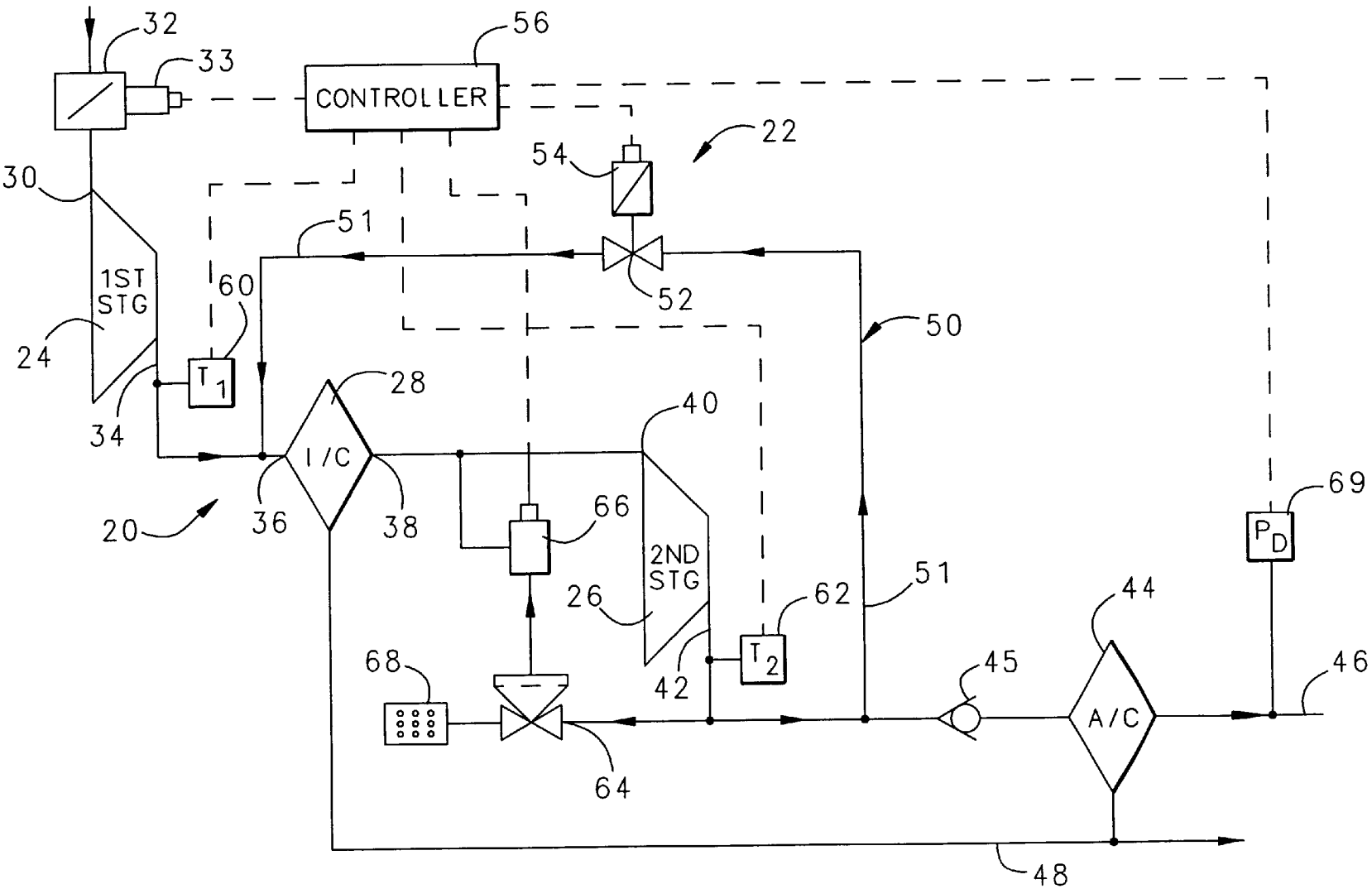
FIG. 1 schematically illustrates a compressor assembly designed according to this invention including a pressure modulation mechanism.

Referring to FIG. 1, a two-stage compressor assembly 20 includes a pressure modulation arrangement 22. The two-stage compressor assembly 20 includes a first stage compressor portion 24 and a second stage compressor portion 26, which comprise conventional components. The compressor components may be selected from among a variety of commercially available components. Types of two-stage oil free compressor assemblies that will benefit from this invention include rotary screw, reciprocating scroll or centrifugal arrangements, for example. This invention is not limited to any particular type of gas compressor in an oil free two-stage compressor assembly.

An interstage circuit 28 is coupled between the first stage portion 24 and the second stage portion 26. The interstage cooler 28 comprises a conventional heat exchanger in one example.

The first stage compressor portion 24 has an intake side 30 fluidly coupled with an intake valve 32. In the illustrated example, the operating position of the intake valve 32 is controlled by an electrical actuator 33. The operating position of the intake valve 32 controls the amount of fluid flow into the compressor assembly. The first stage compressor portion 24 has an output side 34. An input side 36 of the interstage cooler 28 is coupled to the output side 34 of the first stage compressor portion 24. An output side 38 of the interstage cooler 28 is coupled with an input 40 of the second stage compressor portion 26. The output side 42 of the second stage portion 26 is coupled with an aftercooler 44, which may be a conventional heat exchanger, for example. A check valve 45 preferably is positioned between the output side 42 of the second stage portion 26 and the aftercooler 44. The check valve 45 provides isolation between the compressor assembly 20 and remaining components of the system that are coupled to an output line 46, for example.

A conventional drain line 48 preferably is provided to direct condensation as may occur because of the operation of the interstage cooler 28 and the aftercooler 44.

The two-stage compressor assembly 20 may be used in a variety of circumstances. Under certain conditions, a difference between the pressure ratio of the first stage portion 24 and the pressure ratio of the second stage portion 26 may exist. When the difference between the pressure ratios is significant enough, there is an undesirably high difference between the discharge temperatures of the first stage portion 24 and the second stage portion 26. A primary way of determining the difference between the pressure ratios is to monitor differences in output temperatures ($T_1$, $T_2$) of the first and second stage portions, respectively.

The inventive system includes the pressure modulation arrangement 22 to facilitate maintaining the discharge temperatures of the first and second stage portions as close to each other as possible. By keeping the discharge temperatures as close as possible, the inventive arrangement enhances the ambient temperature capability of the assembly and provides enhanced altitude capability. The closer that the discharge temperatures are kept, the higher the ambient temperature and altitude capabilities of the assembly 20. A pressure modulation mechanism connection 50 including a conduit 51 allows a selected amount of fluid flow from the output of the second stage portion 26 back to the inlet of the interstage cooler 28, raising the interstage pressure. This action raises the pressure ratio of the first stage and lowers the second. A valve 52 preferably is associated with the pressure modulation mechanism 50 to control the amount of fluid flow through the conduit 51. In some examples an electric actuator 54 controls the position of the valve 52. Depending on the difference between $T_1$ and $T_2$, the controller 56 communicates with the electrical actuator 54 to adjust the position of the valve 52 so that the amount of fluid flow through the pressure modulation mechanism 50 is controlled as desired to achieve a reasonable balance between the discharge temperatures of the first and second stages.

The controller 56 can be a commercially available microprocessor. In one example, the controller 56 is a dedicated microprocessor. In another example, the controller 56 is a portion of a controller already associated with the two-stage compressor assembly 20. Given this description, those skilled in the art will be able to suitably program a microprocessor to perform the functions of the example controller 56.

The controller 56 communicates with sensors indicating the operating condition of the compressor assembly 20. The example of FIG. 1 includes temperature sensors 60 and 62 that provide temperature information to the controller 56. The sensor 60 provides information regarding a discharge temperature $T_1$ of the first stage portion 24. The temperature sensor 62 provides the second stage portion discharge temperature $T_2$ information. The temperature sensors 60 and 62 can be commercially available sensors that are selected to perform adequately within the expected temperature range and the environment within which the compressor assembly 20 operates.

Based upon the temperature information, the controller 56 controls the electrical actuators 33 and 54 to control the flow through the compressor assembly 20 and through the pressure modulation mechanism 50. The controller 56 preferably is programmed to include information indicating desired relationships between discharge temperatures $T_1$ and $T_2$ and the position of the valve 52. The controller 56 preferably is also programmed to include information indicating a maximum allowable difference between the discharge temperatures of the first stage portion 24 and the second stage portion 26. The controller 56 operates to automatically adjust the position of the valve 52 to regulate the amount of fluid flow through the pressure conduit 51 so that the discharge temperatures of the first stage portion 24 and the second stage portion 26 are as close to equal as possible.

In situations where a controller electronically controls the operation of the intake valve 32 and the needle valve 52, the controller preferably is programmed to coordinate the operation of the valves. In this arrangement, limited capacity modulation is achievable by modulating the pressure ratio of each stage. In one example, the opening and closing of the valves is simultaneous and in reverse of each other. In other words, whenever the intake valve 32 is opened, the needle valve 52 is closed. Similarly, as the intake valve 32 is closed, the needle valve 52 is opened.

When the upper limit of the discharge air pressure, $P_d$, is reached, the controller gradually opens the needle valve 52 and closes intake valve 32, attempting to reduce intake flow while equalizing the discharge temperatures $T_1$, and $T_2$. Depending on demand, this action can be repeated until the discharge temperatures ($T_1$ or $T_2$) reach the maximum acceptable limit, at which point the compressor unloads. Unloading is achieved by an action taken by the controller, which nearly closes the intake valve while it simultaneously opens a blow down valve 64. In this mode the blow down valve 64 dumps the insignificant compressor air output into the atmosphere. A solenoid valve 66 and a muffler 68 are associated with the blow down valve 64 to provide a blow down system as part of the compressor assembly 20.

While running in the unloaded mode, if the discharge air pressure, $P_d$, determined through a pressure transducer 69 reaches the minimum set point, the controller loads the compressor by fully opening the intake valve and closing the blow down valve 64. The controller then adjusts needle valve 52 to nearly balance the discharge temperature of each stage.

Such an arrangement avoids temperatures spikes associated with capacity modulation of oil free two-stage compressors. Capacity modulation is believed to reduce load/unload cycling leading to a reduction in the load and thermal fluctuations imposed on the compressor and increase reliability.

An automated control arrangement is particularly useful for situations where the compressor assembly may be operating at different sites and under different environmental conditions (i.e., rental equipment). As noted above, if the compressor assembly is at a higher altitude, the discharge temperature from the second stage 26 may tend to increase much more than desired as a result of an imbalance between the pressure ratios of the first and second stage portions.

Figure 2:
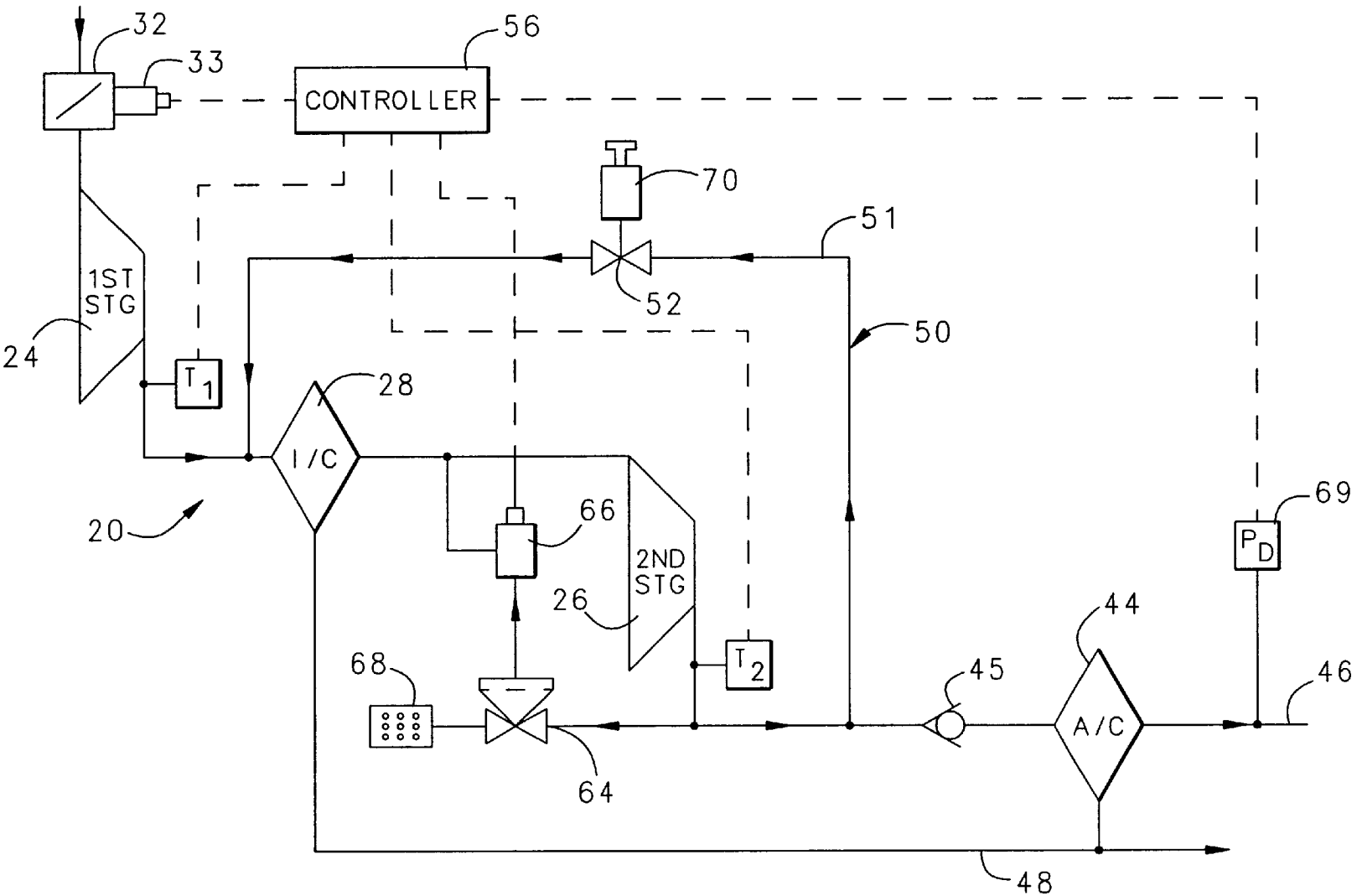
FIG. 2 schematically illustrates another example compressor assembly designed according to this invention.

Under some circumstances the compressor assembly 20 will be positioned in a single location for the anticipated service lifetime of the assembly. Under such situations it is possible to set the position of the valve 52 and not require an automated adjustment strategy. Such an example is schematically illustrated in FIG. 2 where a manual adjustment mechanism 70 is associated with the valve 52. A qualified technician may inspect the operation of the compressor assembly 20 and set the operating position of the valve 52 needed to achieve the desired operating parameters such as equal discharge temperatures from the first stage portion 24 and second stage portion 26. Once the system is balanced, the adjustment mechanism preferably is locked to prevent drifting.

In the examples of FIGS. 1 and 2 the pressure modulation mechanism conduit extends between an output of the second stage portion and an upstream or input side of the interstage cooler 28. The output fluid from the second stage portion that flows through the pressure modulation conduit 51 in these examples includes warm or hot fluid and, therefore, it is desirable to have that fluid cooled through the interstage cooler 28 before it is fed back into the second stage portion 26. Such additional cooling assists in reducing the discharge temperature of the second stage portion 26 and provides the desired amount of pressure modulation.

Figure 3:
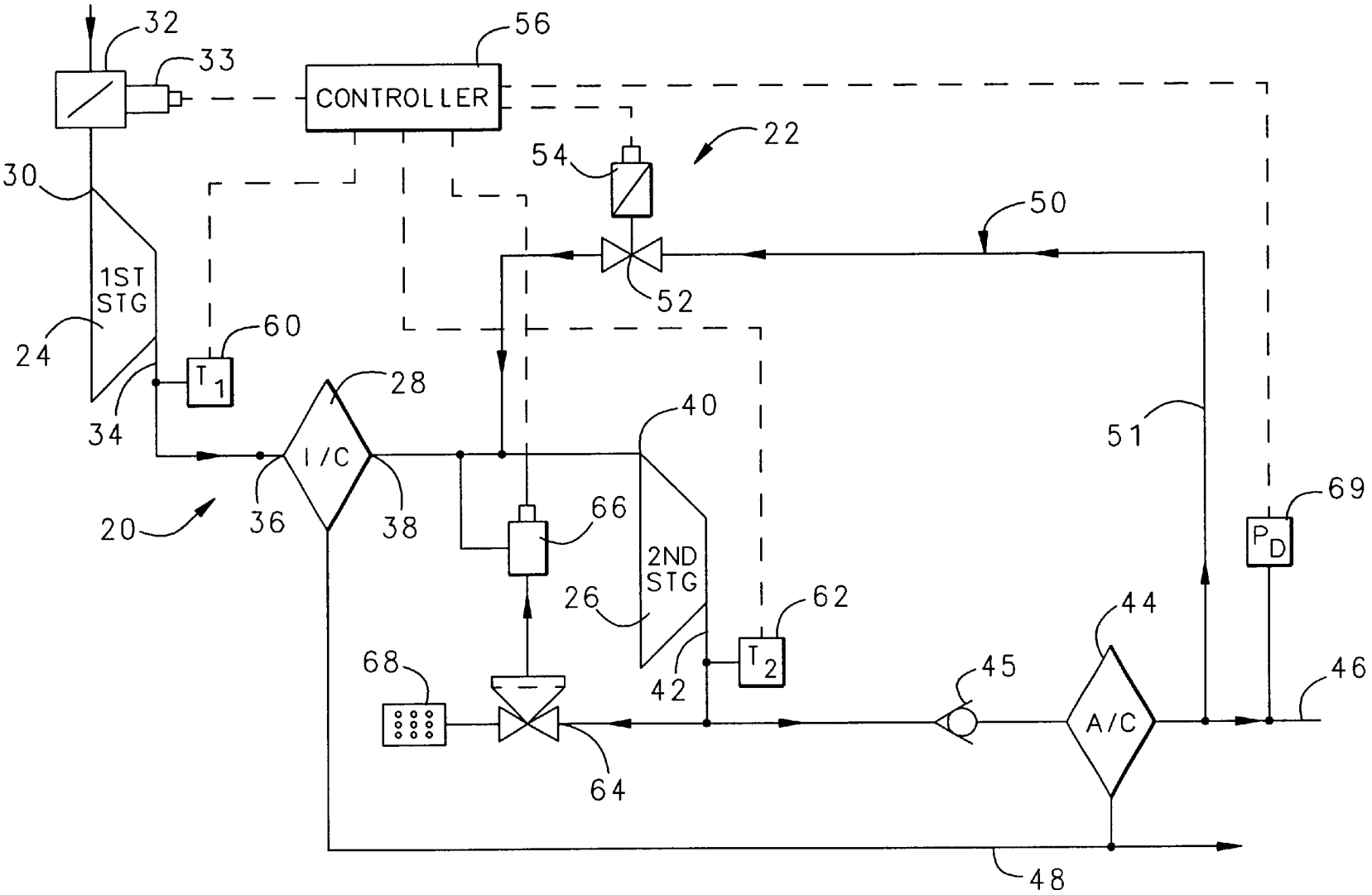
FIG. 3 illustrates a modified embodiment of the inventive system.

In the example of FIG. 3, the pressure modulation conduit 51 extends between an output of the aftercooler 44 and the interstage circuit 28. In this example, the pressure modulation mechanism 50 reintroduces the fluid taken from the output of the aftercooler 44 downstream of the interstage cooler 28 and upstream of the input side 40 of the second stage portion 26. In this example, the fluid flowing through the pressure modulation conduit has already been cooled in the aftercooler 44 and, therefore, it may not be desired or necessary to further cool such fluid using the heat exchanger of the interstage circuit 28 before that fluid is reintroduced into the second stage portion 26.

One potential disadvantage associated with an arrangement as schematically illustrated in FIG. 3 is that in the unload mode, the fluid used for pressure modulation (i.e., the fluid that is fed back to interstage through the pressure modulation mechanism 50) tends to bleed off the customer system air through the blow down valve 64. This may, in some circumstances for example, impact the usage duration of the stored capacity of the customer system. Given this description, those skilled in the art will be able to select the best strategy for providing a pressure modulation mechanism 50 and to be able to choose the optimum connection for a given application.

This invention provides a number of advantages for operating an oil free two-stage compressor system. Capacity modulation according to this invention can reduce cycling, which leads to increased reliability and enhanced system life. Moreover, the inventive pressure modulation technique increases the operating envelope of the compressor assembly so that the ambient temperature and altitude capability of the assembly is enhanced.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A compressor assembly, comprising:

a first stage compressor portion;

a second stage compressor portion coupled with the first stage portion downstream of the first stage portion;

an interstage cooler between the first and second stage portions with an intake side downstream of the first stage portion and an output side upstream of the second stage portion; and a pressure modulation mechanism between an output from the second stage portion and the interstage cooler, the pressure modulation mechanism allowing selective fluid communication from the second stage portion to the interstage cooler downstream of the first stage portion.

2. The assembly of claim 1, including a valve associated with the pressure modulation mechanism that is selectively opened to allow fluid to flow through the pressure modulation mechanism.

3. The assembly of claim 2, wherein the valve comprises a needle valve.

4. The assembly of claim 2, including an intake valve upstream of an intake side of the first stage portion and wherein one of the intake valve or the valve associated with the pressure modulation mechanism is opened when the other valve is closed.

5. The assembly of claim 4, including a controller that controls operation of the valves such that the opening and closing of the valves is coordinated.

6. The assembly of claim 5, wherein the compressor assembly is an oil free compressor assembly and the controller provides capacity modulation.

7. The assembly of claim 2, including a manual adjustor associated with the valve that allows an individual to set a position of the valve to allow a chosen flow through the pressure modulation connection.

8. The assembly of claim 1, including a controller that is programmed to allow flow through the pressure modulation mechanism when a discharge temperature of the second stage portion is above a chosen threshold.

9. The assembly of claim 1, including a controller that determines a discharge temperature of the first stage portion and a discharge temperature of the second stage portion and the controller allows flow through the pressure modulation mechanism when a difference between the discharge temperatures exceeds a chosen threshold.

10. The assembly of claim 1, wherein the pressure modulation mechanism couples the output of the second stage portion to an upstream side of the interstage cooler.

11. The assembly of claim 1, including an aftercooler downstream of the output of the second stage portion and wherein the pressure modulation mechanism couples a downstream side of the aftercooler to a downstream side of the interstage cooler.

12. The assembly of claim 1, including a blow down valve coupled to the output of the second stage portion, a control valve associated with the blow down valve to selectively allow fluid flow through the blow down valve and a muffler between the blow down valve and atmosphere.

13. A method of controlling a compressor assembly having a first stage compressor portion, a second stage compressor portion coupled with the first stage portion downstream of the first stage portion, and an interstage cooler between the first and second stage portions, comprising the steps of:

(A) monitoring a discharge temperature condition of the first and second stage portions, respectively;

(B) determining whether a difference between the monitored temperatures is outside of a chosen range; and (C) allowing a desired amount of fluid communication from the second stage portion to the interstage circuit when the temperature difference is outside of the chosen range.

14. The method of claim 13, including providing a pressure modulation mechanism between an output from the second stage portion and the interstage cooler and performing step (C) by controlling fluid flow through the pressure modulation mechanism.

15. The method of claim 14, wherein the compressor assembly includes an aftercooler downstream of the second stage portion and the pressure modulation mechanism couples an output of the aftercooler with a downstream side of the interstage cooler.

16. The method of claim 14, wherein the pressure modulation mechanism couples an output of the second stage portion with an upstream side of the interstage cooler.

17. The method of claim 13, wherein step (C) is performed when the discharge temperatures are not equal.

18. The method of claim 13, wherein step (C) is performed when a difference between the discharge temperatures is above a chosen threshold.

19. The method of claim 13, wherein the compressor assembly includes an air intake valve associated with the first stage portion and a needle valve associated with a coupling between an output side of the second stage portion and the interstage cooler and including controlling the intake valve and the needle valve to increasingly open one of the valves when the other is increasingly closing.

20. The method of claim 13, wherein the compressor assembly is an oil free assembly and including providing capacity modulation.

21. A compressor assembly, comprising:

a first stage compressor portion;

a second stage compressor portion coupled with the first stage portion downstream of the first stage portion;

an interstage circuit between the first and second stage portions with an intake side downstream of the first stage portion and an output side upstream of the second stage portion;

a pressure modulation mechanism between an output from the second stage portion and the interstage circuit, the pressure modulation mechanism allowing selective fluid communication from the second stage portion to the interstage circuit;

a valve associated with the pressure modulation mechanism that is selectively opened to allow fluid to flow through the pressure modulation mechanism;

an intake valve upstream of an intake side of the first stage portion and wherein one of the intake valve or the valve associated with the pressure modulation mechanism is opened when the other valve is closed;

a controller that controls operation of the valves such that the opening and closing of the valves is coordinated; and wherein the compressor assembly is an oil free compressor assembly and the controller provides capacity modulation.

22. A compressor assembly, comprising:

a first stage compressor portion;

a second stage compressor portion coupled with the first stage portion downstream of the first stage portion;

an interstage circuit between the first and second stage portions with an intake side downstream of the first stage portion and an output side upstream of the second stage portion;

a pressure modulation mechanism between an output from the second stage portion and the interstage circuit, the pressure modulation mechanism allowing selective fluid communication from the second stage portion to the interstage circuit;

a valve associated with the pressure modulation mechanism that is selectively opened to allow fluid to flow through the pressure modulation mechanism; and a manual adjustor associated with the valve that allows an individual to set a position of the valve to allow a chosen flow through the pressure modulation connection.

23. A compressor assembly, comprising:

a first stage compressor portion;

a second stage compressor portion coupled with the first stage portion downstream of the first stage portion;

an interstage circuit between the first and second stage portions with an intake side downstream of the first stage portion and an output side upstream of the second stage portion;

a pressure modulation mechanism between an output from the second stage portion and the interstage circuit, the pressure modulation mechanism allowing selective fluid communication from the second stage portion to the interstage circuit; and a controller that is programmed to allow flow through the pressure modulation mechanism when a discharge temperature of the second stage portion is above a chosen threshold.

24. A compressor assembly, comprising:

a first stage compressor portion;

a second stage compressor portion coupled with the first stage portion downstream of the first stage portion;

an interstage circuit between the first and second stage portions with an intake side downstream of the first stage portion and an output side upstream of the second stage portion;

a pressure modulation mechanism between an output from the second stage portion and the interstage circuit, the pressure modulation mechanism allowing selective fluid communication from the second stage portion to the interstage circuit; and a controller that determines a discharge temperature of the first stage portion and a discharge temperature of the second stage portion and the controller allows flow through the pressure modulation mechanism when a difference between the discharge temperatures exceeds a chosen threshold.

25. A compressor assembly, comprising:

a first stage compressor portion;

a second stage compressor portion coupled with the first stage portion downstream of the first stage portion;

an interstage circuit between the first and second stage portions with an intake side downstream of the first stage portion and an output side upstream of the second stage portion;

a pressure modulation mechanism between an output from the second stage portion and the interstage circuit, the pressure modulation mechanism allowing selective fluid communication from the second stage portion to the interstage circuit; and an aftercooler downstream of the output of the second stage portion and wherein the pressure modulation mechanism couples a downstream side of the aftercooler to a downstream side of the interstage circuit.

26. A compressor assembly, comprising:

a first stage compressor portion;

a second stage compressor portion coupled with the first stage portion downstream of the first stage portion;

an interstage circuit between the first and second stage portions with an intake side downstream of the first stage portion and an output side upstream of the second stage portion;

a pressure modulation mechanism between an output from the second stage portion and the interstage circuit, the pressure modulation mechanism allowing selective fluid communication from the second stage portion to the interstage circuit; and a blow down valve coupled to the output of the second stage portion, a control valve associated with the blow down valve to selectively allow fluid flow through the blow down valve and a muffler between the blow down valve and atmosphere.

* * * * *

UNITED STATES PATENT AND TRADEMARK OFFICE

CERTIFICATE OF CORRECTION

PATENT NO. : 6,638,029 B2
DATED : October 28, 2003
INVENTOR(S) : Kharsa

It is certified that error appears in the above-identified patent and that said Letters Patent is hereby corrected as shown below:

Column 7,
Line 15, "circuit" should be -- cooler --

Signed and Sealed this

Ninth Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,638,029 B2
DATED : October 28, 2003
INVENTOR(S) : Kharsa

It is certified that error appears in the above-identified patent and that said Letters Patent is hereby corrected as shown below:

Column 7,
Line 15, "circuit" should be -- cooler --

Signed and Sealed this

Eighteenth Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,638,029 B2
APPLICATION NO. : 10/025229
DATED : October 28, 2003
INVENTOR(S) : John Kharsa It is certified that error appears in the above-identified patent and that said Letters Patent is hereby corrected as shown below:

Title Page (73) Assignee: "Hamilton Sunstrand Corporation" should read as --Hamilton Sundstrand Corporation--

Signed and Sealed this

Ninth Day of June, 2009

JOHN DOLL
*Acting Director of the United States Patent and Trademark Office*